United States Patent [19]

Sawada

[11] Patent Number: 4,637,846

[45] Date of Patent: Jan. 20, 1987

[54] NICKEL-TITANIUM-BERYLLIUM ALLOY WIRE

[75] Inventor: Kazuo Sawada, Osaka, Japan

[73] Assignee: Sumitomo Electric Industries, Ltd., Osaka, Japan

[21] Appl. No.: 706,625

[22] Filed: Feb. 28, 1985

Related U.S. Application Data

[63] Continuation-in-part of Ser. No. 508,511, Jun. 28, 1983, abandoned.

[30] Foreign Application Priority Data

Jun. 29, 1982 [JP] Japan ..... 57-113420

[51] Int. Cl.[4] ..... C22C 19/03

[52] U.S. Cl. ..... 148/402; 148/2; 148/11.5 F; 148/11.5 N

[58] Field of Search ..... 148/402, 2, 11.5 F, 148/11.5 N

[56] References Cited

U.S. PATENT DOCUMENTS 4,144,057 3/1979 Melton et al. ..... 148/402

*Primary Examiner*—R. Dean

*Attorney, Agent, or Firm*—Birch, Stewart, Kolasch & Birch

[57] ABSTRACT

A method of manufacturing a nickel-titanium-beryllium alloy wire, comprising the steps of preparing a nickel-titanium alloy consisting essentially of nickel (Ni) 50 to 40% by weight and titanium (Ti) 40 to 50% by weight, with a portion of either the Ni or Ti being replaced by from 0.005 to 0.5% beryllium (Be), brining the nickel-titanium-beryllium alloy to a molten state, and jetting a melt of the alloy into a liquid flow, formed as a laminar flow, on the internal surface of a rotating drum so as to cool and solidify the nickel-titanium-beryllium alloy from its molten state into a fine wire at an average cooling rate in the range of $10^2$ to $10^4$ C/sec.

4 Claims, 2 Drawing Figures

NICKEL-TITANIUM-BERYLLIUM ALLOY WIRE

This application is a continuation-in-part of U.S. application Ser. No. 508,511, filed June 28, 1983, now abandoned.

BACKGROUND OF THE INVENTION

The present invention relates to a method of manufacturing a nickel-titanium-beryllium alloy wire and the resulting product.

Description of the Prior Art

NiTi alloys exhibiting a variety of properties have been found and research as to their application has continued. However, generally a NiTi alloy has poor coldworkability and it has been difficult to work into a wire material, strip material or the like. NiTi alloy has an ordered structure and a brittleness due to such a structure, causes the difficulty in cold working. In the case of a shape memory alloy giving rise to a thermoelastic martensitic transformation, such as a NiTi alloy (including an alloy exhibiting a super elasticity or damping effect), difficult workability of such a material having a low temperature at which its martensitic transformation takes place has been an obstacle to a reduction in cost.

Therefore, an attempt has been made to fabricate a ribbon-like piece using a single-roll rapid quenching apparatus in order to eliminate such a difficulty in cold working; however, this property inherent in a NiTi alloy has not been fully eliminated. In the case of a NiTi alloy, taken as an example of a shape memory alloy, a method of manufacture by the use of a rapid quenching technique results in an insufficient shape memory effect and furthermore results in an unstable transformation point depending on the manufacturing conditions. The reason for this is that a portion of a NiTi alloy becomes amorphous due to rapid cooling or quenching of the alloy by the use of such a single-roll apparatus, with the result that a property that could have been attained with an inherent crystal structure of a NiTi alloy is not fully exhibited. Furthermore, another reason why the transformation point is unstable is presumably that, due to such rapid cooling, the crystal structure becomes different from that attained by ordinary plastic working.

SUMMARY OF THE INVENTION

The present invention proposes to solve the above described problems and, as such, a principal object of the present invention is to provide a method of manufacutring a nickel-titanium-beryllium alloy wire retaining its inherent properties.

According to the present invention, a NiTi alloy containing a small amount of beryllium is directly solidified from its molten state to a fine wire state at an average cooling speed of an appropriate range. Accordingly, intermediate working steps of the alloy generally known as a difficult workable material can be dispensed with. As a result, manufacture of a NiTiBe alloy wire becomes easy and hence reduction in cost of manufacutre can be achieved. Furthermore, since solidificataion is made at a cooling speed of an appropriate range, the alloy can be prevented from becoming amorphous and therefore an inherent functional effect, such as a shape memory effect, of the resulting NiTiBe alloy is not degraded.

In a preferred embodiment of the present invention, a solidifying apparatus of a rotating drum type is employed. In such a case, the NiTiBe alloy wire having a circular cross section can be provided with ease.

These objects and other objects, features, aspects and advantages of the present invention will become more apparent from the following detailed description of the present invention when taken in conjunction with the accompanying drawings.

BRIEF DESCRIPTION OF THE PREFERRED EMBODIMENTS

Figure 1:
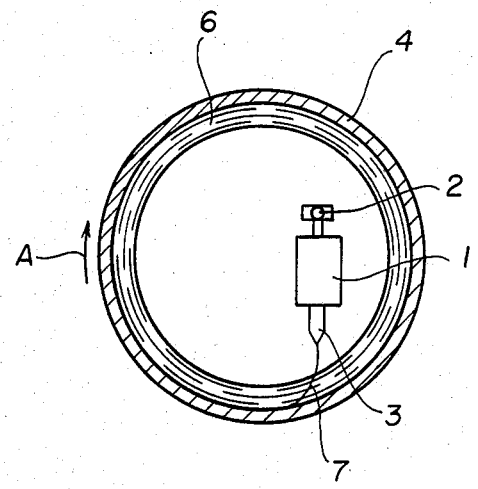
FIG. 1 is a front view showing diagrammatically one example of an apparatus for use in practicing the present invention.
Figure 2:
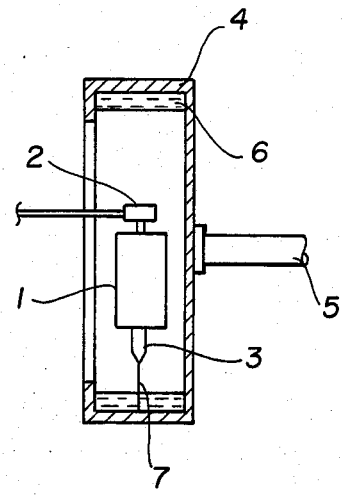
FIG. 2 is a side view of the apparatus shown in FIG. 1, partially fragmentary to show the detail of the structure.

FIGS. 1 and 2 are views diagrammatically showing one example of an apparatus for use in practicing the present invention. A NiTiBe alloy consisting essentially of about 50 to 60% by weight nickel (Ni) and 40 to 50% by weight titanium (ti), with a portion of either the Ni or the Ti being replaced by from 0.005 to 0.5% beryllium (Be), in a molten state, is stored in a crucible 1. A gas inlet 2 is provided toward the upper portion of the crucible 1 for introduction of a gas, such as an argon gas, into the crucible 1. A nozzle 3 having an orifice, not shown in the figures, at the tip end thereof is provided at a lower portion of the crucible 1. As shown in the figures, a rotating drum 4 is provided so as to enclose the crucible 1. The rotating drum 4 is coupled to a driving source through a shaft 5, so that the same may be rotated in the direction of arrow A about the axis of the shaft 5. Although not shown, a liquid supply port for supplying a cooling liquid or coolant, such as water, is provided at a given position in the rotating drum 4.

A liquid is supplied from the liquid supply port into the rotating drum 4. The liquid as supplied into the rotating drum 4 forms a laminar flow (denoted by the reference numeral 6 in the figures) on the inner peripheral surface of the rotating drum 4. A gas is introduced from the gas inlet 2 into the crucible 1 in such a state so that the inside of the crucible 1 is pressurized by the gas. Accordingly, the melt as stored in the crucible 1 is jetted from the tip end orifice of the nozzle 3 by the pressure. The jetted melt is cooled and solidified in the liquid laminar flow 6, so that a fine wire 7 having a circular cross section is formed on the inner peripheral surface of the rotating drum 4.

The cooling speed for solidifying the melt may be varied by changing the kind of liquid used as the cooling liquid or coolant and the temperature of the liquid. Preferably an average cooling rate is $10^{2°}$ to $10^{4°}$ C./sec. The reason for this may be accounted for by the fact that the form as jetted from the nozzle is not stabilized until the melt becomes fully solidified if the average cooling rate is below $10^{2°}$ C./sec, with the result that a fine wire having a uniform diameter cannot be provided, while the solidified NiTiBe alloy becomes amorphous or the crystal structure thereof becomes non-ordered if and when the average cooling rate exceeds C./sec, with the result that a property inherent to the NiTiBe alloy, such as shape memory effect, cannot be fully attained.

Then the following processing is applied so that the shape memory effect of the NiTiBe alloy, as solidified at the above described average cooling rate of $10^{2°}$ C./sec, may be fully realized.

More specifically, a cold working of smaller than 50% is applied to the NiTiBe alloy as cooled and solidified in a fine wire form as described above and then the same is heat treated at 300° C. to 700° C. The purpose of applying the cold working of smaller than 50% is to enhance the tensile strength of the fine wire of the NiTiBe alloy. The reason why the cold working of smaller than 50% is selected in that cold working of larger than 50% threatens to cause a breakage of the fine wire of the NiTiBe alloy during the cold working.

Furthermore, the reason why the heat treatment is limited to the range of 300° C. to 700° C. is that a heat treating temperature below 300° C. cannot attain a sufficient shape memory effect while a heat treating temperature exceeding 700° C. degrades the sensitivity to temperature for the recovery of a shape memory alloy.

Although in the above described embodiment a rotating drum type apparatus was employed in order to solidify a NiTiBe alloy from a molten state, the present invention is not limited to such an apparatus. As stated, an average cooling rate for solidification from a molten state to a state of a fine wire is to be selected to be in the range of $10^2$ to $10^4$.

The NiTiBe alloy referred to above is one which has a portion of the nickel or titanium replaced by beryllium in an amount of from 0.005 to 0.5% by weight. The presence of beryllium makes it possible to produce a continuous fine wire. If the content falls below 0.005% it is difficult to obtain a continuous fine wire. Above 0.5% the effect on the capability to obtain a continuous fine wire by jetting and solidifying the melt of the nickel-titanium-beryllium alloy is no longer increased. Furthermore, a beryllium content in excess of 0.5% will stand to vary the transformation points of the alloy.

The NiTiBe alloy of the present invention may also have a portion of the nickel or titanium replaced by a metal selected from the group consisting of copper, aluminum, zicronium, vanadium, iron and cobalt.

Needless to say, that the method of manufacturing the NiTiBe alloy wire can be applied not only to a NiTiBe alloy having a shape memory effect but also to a NiTiBe alloy wire having a super elasticity, damping or corrosion-resistant effect.

PREFERRED EMBODIMENTS

To further define the specifics of the present invention the following examples are intended to illustrate, but not limit, the subject matter thereof. Parts and percentages are by weight unless otherwise indicated.

EXAMPLE 1

An alloy consisting essentially of Ni of 54.95% by weight, Ti of 44.95% by weight and Be of 0.10% by weight is jetted from a nozzle in a molten state at 1370° C. into a layer of water formed by a centrifugal force in a cylindrical drum, as shown in FIG. 1, at an average cooling rate of $8\times10^{2°}$ C./sec so that the alloy may be solidified to provide a NiTiBe alloy wire of 0.15 mm in diameter.

The fine wire obtained by the above example had a circular cross-section and a continuously extending length. By contrast, in the absence of beryllium, a continuously extending wire was sometimes hard to obtain.

When the wire obtained by the example was bent and heated at a temperature of 70° C., the wire exhibited a shape memory effect of completely reverting to the original shape.

EXAMPLE 2

The NiTiBe alloy wire obtained by Example 1 is subjected to cold working (drawing) of 25% using a lubricant fully cooled to provide a wire of 0.26 mm in diameter. Then tension is applied to the wire and the wire is heat treated at 550° C. for ten minutes while the same is maintained straight. The wire is bent at an angle of 120 in ice water at 0° C. and thereafter the wire is dipped in hot water at 60° C., when the wire reverted to the original straight shape.

EXAMPLE 3

The procesure of Example 1 is repeated to produce an alloy wire, with the substitution of 2% Cu for an equivalent proportion weight % of Ti. The resulting alloy wire exhibits a shape memory effect.

EXAMPLE 4

The procedure of Example 1 is repeated to produce an alloy wire, with the substitution of 0.3 weight % Al and Fe for an equivalent amount of Ni. The resulting alloy wire exhibited a super-elasticity effect.

EXAMPLE 5

The procedure of Example 1 is repeated with the substitution of 0.1 weight % of each of Zn, V and Co for equivalent amounts of Ni. The resulting wire alloy exhibited a shape memory effect.

When average cooling rates vary from 10° C./sec to $5\times10^{4°}$ C./sec, while the wires are changed in diameter and in temperature of the molten alloy, the NiTiBe alloy having the above described shape memory effect can be obtained under conditions of average cooling rates of $10^{2°}$ to $10^{4°}$ C./sec.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A nickel-titanium-beryllium alloy wire produced by the process comprising the steps of:

preparing a nickel-titanium-beryllium alloy having a shape memory effect consisting essentially of 50 to 60 % by weight nickel, 40 to 50% by weight titanium, and beryllium substituted for a portion of the nickel or titanium in quantities of 0.005 to 0.5% by weight, bringing said nickel-titanium-beryllium alloy to a moltan state, jetting a melt of said nickel-titanium-beryllium alloy through an orifice having a circular cross-section into a laminar flowing cooling liquid said alloy remaining in a molten state upon exiting said orifice, and cooling and solidifying said nickel-titanium-beryllium alloy in said laminar flowing cooling liquid from its molten state into a fine wire having a circular cross-section at an average cooling rate in the range of from $10^2$ to $10^{4°}$ C./sec said resulting alloy wire retaining said shape memory effect.

2. The nickel-titanium-beryllium alloy wire as recited in claim 1, wherein said nickel-titanium-beryllium alloy has a portion of the nickel or titanium replaced by a metal selected from at least one member of the group consisting of copper, aluminum, zirconium, vanadium, iron and cobalt in an amount of not more than 2% by weight.

3. The nickel-titanium-beryllium wire of claim 1, wherein said process further comprises the steps of subjecting said nickel-titanium-beryllium alloy, which has been cooled and solidified into a fine wire, to cold working to elongate the wire in an amount less than 50%, and thereafter, heat treating said nickel-titanium-beryllium wire at a temperature of from 300° to 700° C.

4. The nickel-titanium-beryllium wire as recited in claim 1, wherein said laminar flow of said liquid is formed by a centrifugal force exerted on an internal surface of a rotating drum.

* * * * *